US006293549B1

(12) United States Patent
Peter et al.

(10) Patent No.: US 6,293,549 B1
(45) **Date of Patent: *Sep. 25, 2001**

(54) GAME SET BEAST-OF-PREY HUNT

(76) Inventors: Stephan Peter, St.-Martin-Str. 88, D-81541 Munich; Christian Fritz, Rudolf-Zorn-Str. 14, D-81739 Munich, both of (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/342,078

(22) Filed: Jun. 28, 1999

(51) Int. Cl.[7] ..... A63F 3/02
(52) U.S. Cl. ..... 273/262; 273/260; 273/258
(58) Field of Search ..... 273/260, 261, 273/236, 254, 249, 292, 258, 262, 263

(56) References Cited

U.S. PATENT DOCUMENTS 695,431 * 3/1902 Atwood .
817,142 * 4/1906 Fisher .
1,204,246 * 11/1916 Carter .
1,207,466 * 12/1916 Baines .
1,552,354 * 9/1925 Stanage .
2,045,339 * 6/1936 Boland .
5,566,944 * 10/1996 Anderson .
5,647,593 * 7/1997 Kamat .
5,749,583 * 5/1998 Sadounichvili .

* cited by examiner

*Primary Examiner*—Benjamin H. Layno
*Assistant Examiner*—Vishu Mendiratta
(74) *Attorney, Agent, or Firm*—Sidley Austin Brown & Wood, LLP

(57) ABSTRACT

A set for a hunting-a-beast-prey game including two square boards each having twenty-five playing fields and four additional playing fields provided outside of the square defining the twenty-five playing fields, and two times twenty-nine playing figures consisting of twenty-five figures representing hunters, and four figures representing beasts of prey.

1 Claim, 9 Drawing Sheets

GAME SET BEAST-OF-PREY HUNT

BACKROUND AND SUMMARY OF THE INVENTION

The present invention relates to a so-called board game in which opposed figurines are being moved over a board by two players. Board games are known from ancient times and are widely played. Such board games as chess, draughts, go, backgammon are played all over the world.

In particular, the present invention is directed to board game based on a real beast-of-prey hunt, particularly, a tiger hunt.

This game is closely aligned to a real tiger hunt, instinctive and without compromise, with uncertain outcome exactly as it is in a traditional tiger hunt since the times of the Maharadscha in India, Singapore, Malaysia and Sumatra.

The superior number of native hunters is oppressive in the realm of the tiger, however, the animal thus threatened can, once challenged, be devastating in its counter attack. If the players assume the attitude and identity of the figures of the counterpart, at the same time taking into consideration their own strategy, a masterful combat unfolds for their very existence.

The game set consists of a square board having twenty-five playing fields and four additional playing fields arranged, preferably, in the middle of a side of the square, and twenty-nine playing figures consisting of twenty-five hunter figures and four beast-of-prey figures. The playing figures can be made as figurines of a hunter and a tiger or as simple counters.

The game is played by two persons, one playing with the hunter figures, the other playing with the tiger figures. The game is played by first, placing all of the tiger figures on the board, then by alternatively placing the hunter figures, one by one, on the board and moving the tiger figures over the board, and finally, if the game has not ended by that time, by displacing alternatively the hunter and tiger figures over the board in the available free fields until one of the players wins, or there is "remis". Both the hunter figures and the tiger figures can be displaced only linearly, in the same row, forward, backward, rightward, and leftward, and only by one field at a time. A player can move the same figure no more than three times in a row. Both players have to consider all "eatings "("eating" has the same meaning as killing which will be explained further below) which can be done by the player-tiger during his turn before the player-tiger starts the first "eating". If the player-tiger does not "eat" the maximum possible number of hunters, the player-hunter shall take the "guilty" tiger out of the game and kill it. The "guilty" tiger is the one which has missed to "eat" the maximum possible number of hunters. If both players do not recognize the counterparts mistake the game must be continued without hesitation. This means no move will be retrieved/redrawn/reversed.

The player-hunter wins when he/she kills (what constitutes killing will be explained below) and/or locks all of the tigers in a cage (cages), and/or detains the tiger(s) in a single field(s) without a possibility of movement. The cages are represented by the four additional outside fields and a tiger becomes locked in a cage when two hunters behind each other, opposite of the tiger in the adjacent to the cage field of the board prevents the tiger from moving out (see FIG. 18). The player-hunter should observe the displacement of the tigers by the player-tiger very carefully because if the player-tiger commits an error in displacing a tiger (what constitutes an error will be explained further bellow), the player-hunter can remove the erroneously displaced tiger figure from the board, and kill it.

The player-tiger wins when the tigers "eat" all of the hunters. A tiger "eats" a hunter when the tiger figure can jump over the hunter figure or moves between two hunter figures (which is called MANDUA). A combination of over-jumping and the move between two hunters (MANDUA) is possible. A tiger can jump over a hunter when the tiger is located in a field adjacent to the hunters field and the field behind the hunter opposite to the tiger is free. When a tiger moves between two hunters, the tiger "eats" both of them.

BRIEF DESCRIPTION OF THE DRAWINGS

The objects and advantages of the present invention will become more apparent, and the invention itself will be best understood from the following detailed description of the Preferred Embodiment, when read with reference to the accompanying drawings, wherein.

DETAILED DESCRIPTION OF THE PREFERRED EMBODIMENTS

Figure 1:
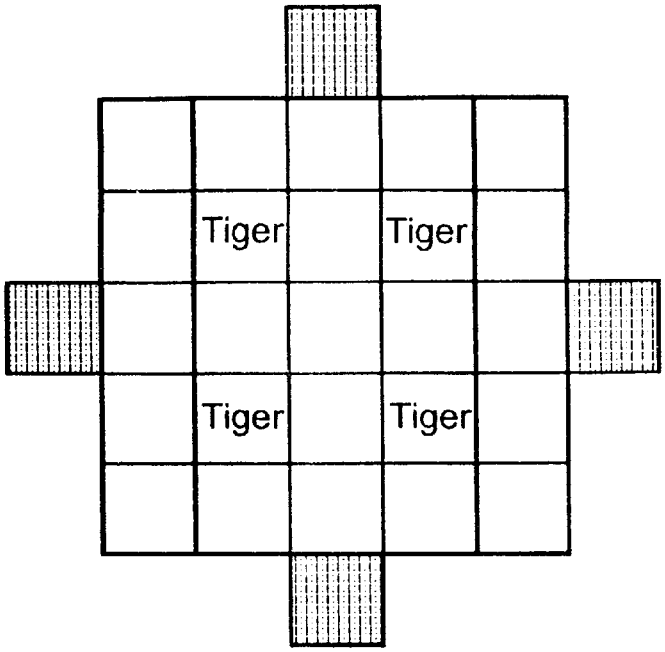
FIG. 1 shows the beginning position of a game.

The detailed description will be limited to discussion of possible game situations. FIG. 1 shows the beginning position of the game.

Figure 2:
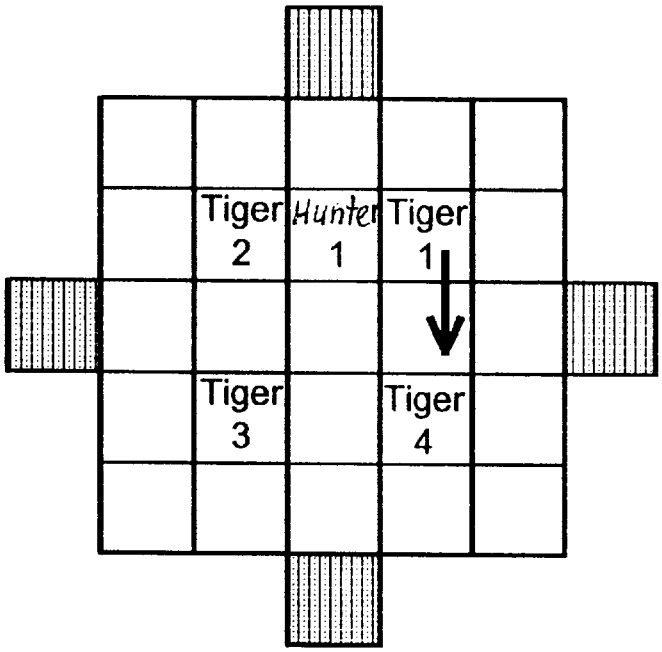
FIGS. 2–17 show positions of different situations during the game.
Figure 3:
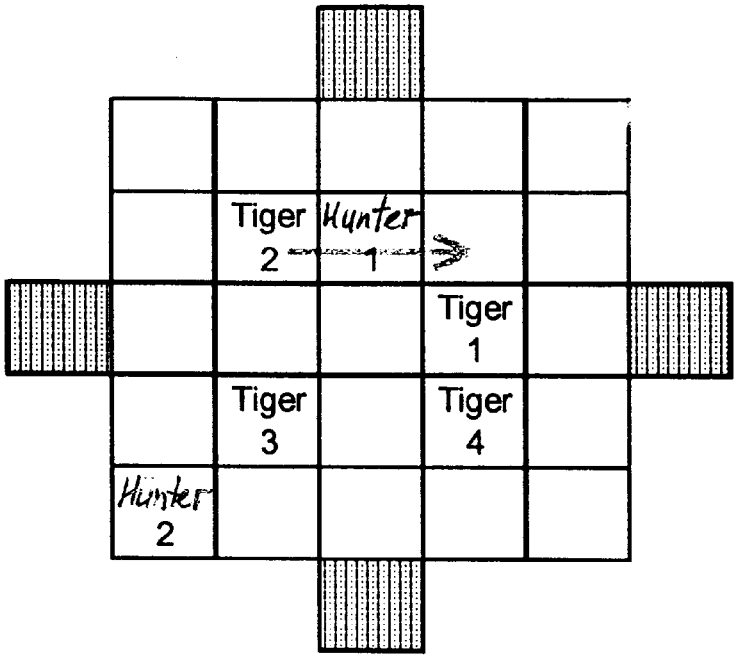

The player-hunter starts from placing the single hunter on the board, e.g., by placing a hunter 1, inadvertently, between two tigers (see FIG. 2). During the next movement, the player-tiger moves the tiger 1 downward, as shown by arrow in FIG. 2. After the next movement of the player-hunter, who places the hunter 2 in a corner field of the board, as shown in FIG. 3 (as discussed above, the player-hunter cannot move hunters on the board, until all hunters are placed on the board). During the following movement, the player-tiger moves the tiger 2 over the hunter I in the field preciously occupied by the tiger 1, and "eats" the hunter. It is to be noted that the player-hunter should not place the hunter 2 adjacent to the hunter I to block the movement of the tiger 2 because the tiger 1 would jump over the hunter 2, and the hunter 1 would still remain vulnerable.

Figure 4:
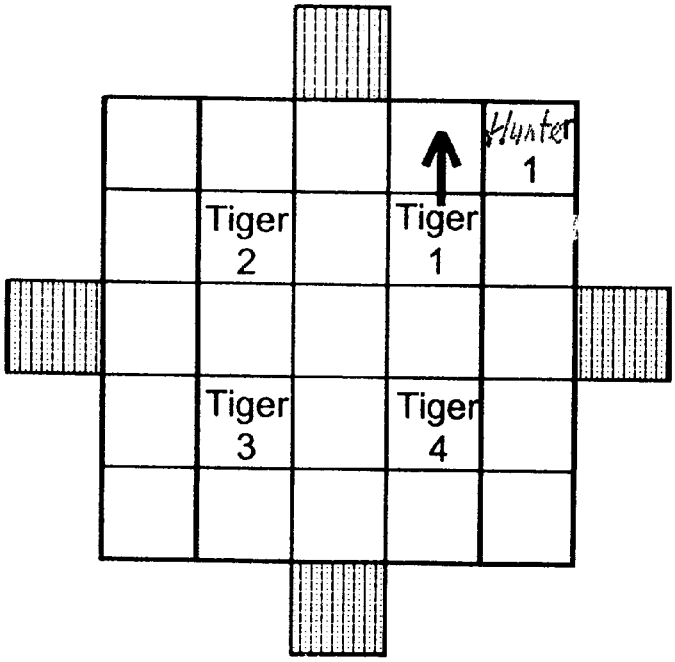
Figure 5:
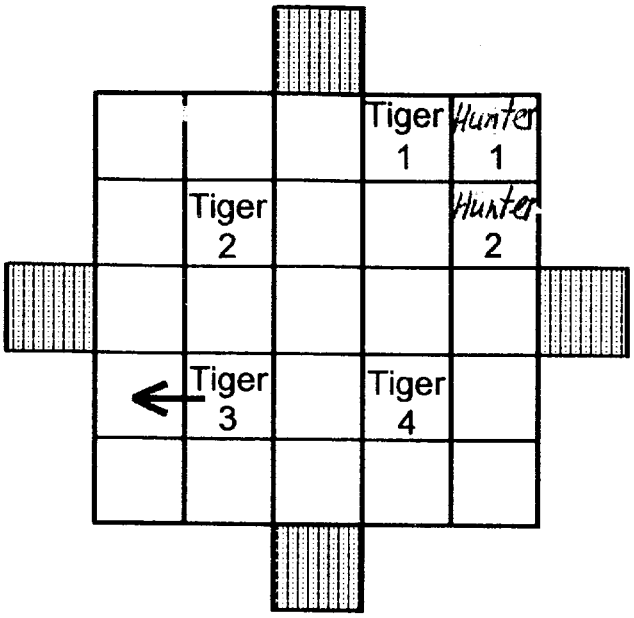
Figure 6:
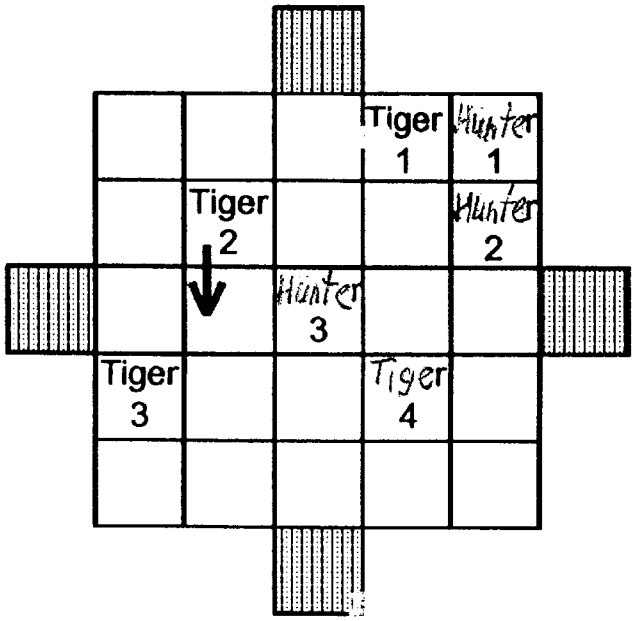
Figure 7:
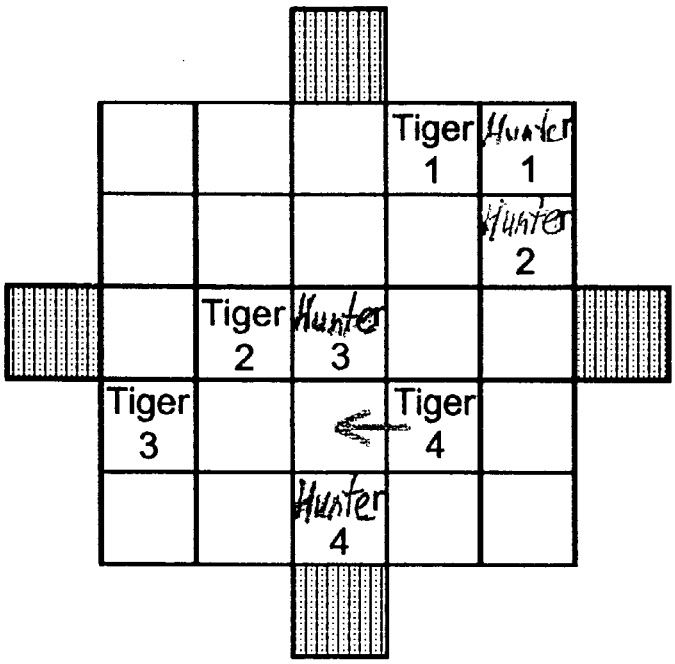
Figure 8:
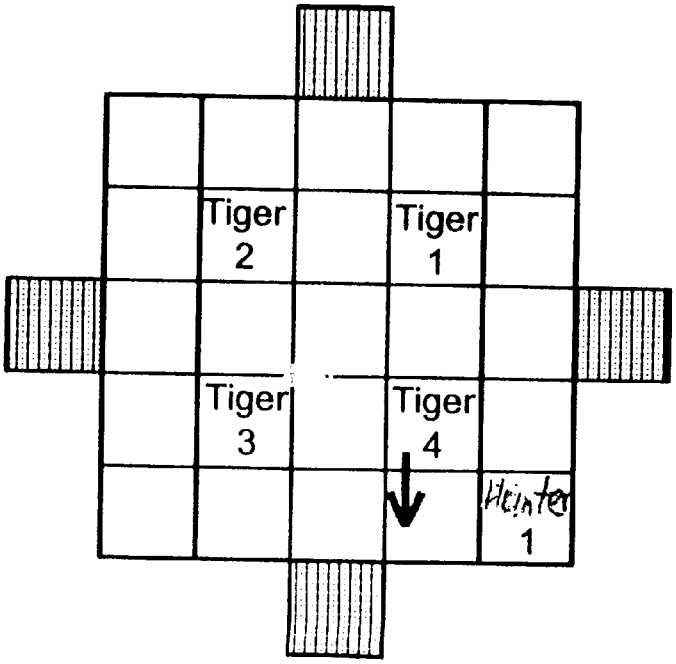
Figure 9:
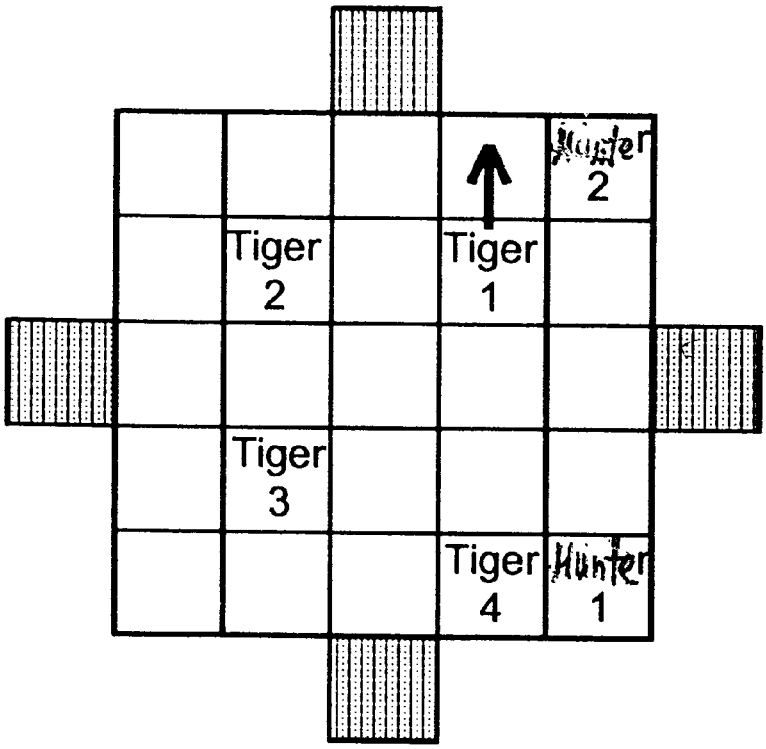
Figure 10:
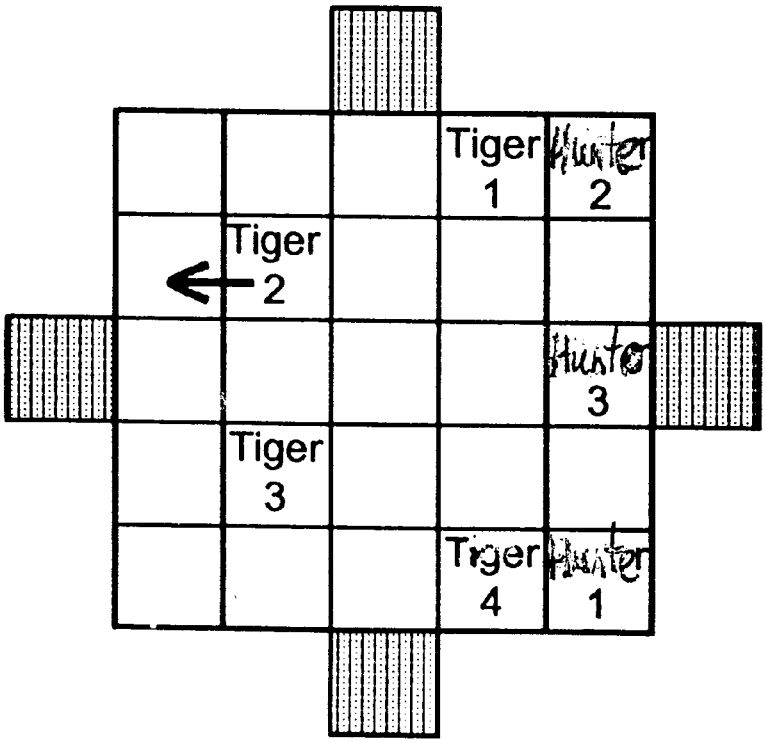
Figure 11:
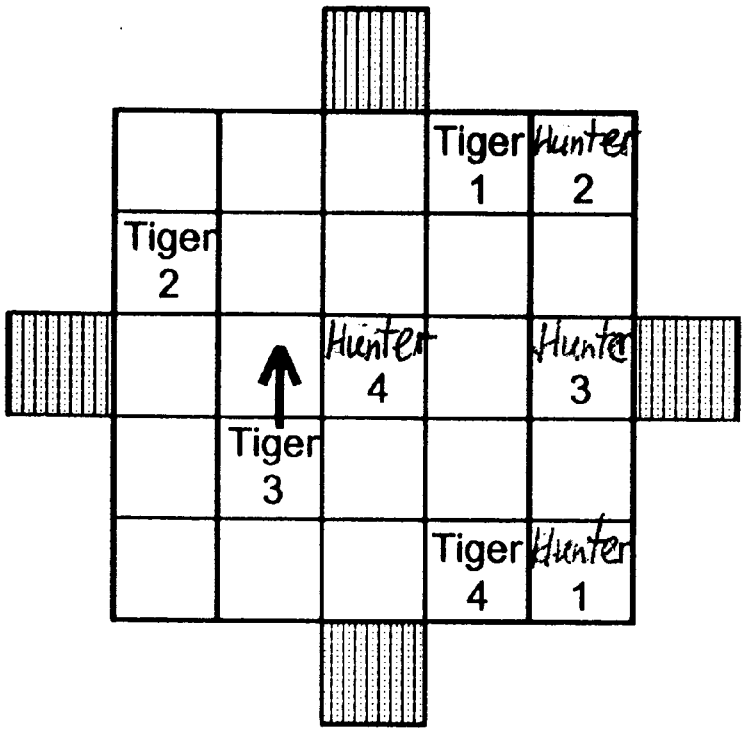

FIGS. 4–7 show another game situation named MANDUA. The starting position is the same as in FIG. 1. The player-hunter places the hunter 1 in the right upper corner field of the board. The player-tiger moves the tiger 1 next to the hunter 1. This position is shown in FIG. 4. As shown in FIG. 5, the player-hunter places the second hunter 2 beneath the hunter 1, and the player-tiger moves the tiger 3 leftwards, as shown by an arrow. In his/her next move, the player-hunter places the hunter 3 in the middle of the board, as shown in FIG. 6, and the player-tiger moves the tiger 2 downward adjacent to the hunter 3. Then, the player-hunter places the hunter 4 on the board, as shown in FIG. 7. The player-tiger moves tiger 4 between the hunter 3 and 4 and "eats" both hunters (MANDUA). The player-tiger should not move the tiger 2 over the hunter 3 because the aim of the player-tiger is to "eat" a maximum possible number of hunters. If the player-tiger moved the tiger 2, this would have been an error, and he/she would have lost the tiger 4, the "guilty" tiger, who could have "eaten" the maximum possible number of hunters.

Figure 12:
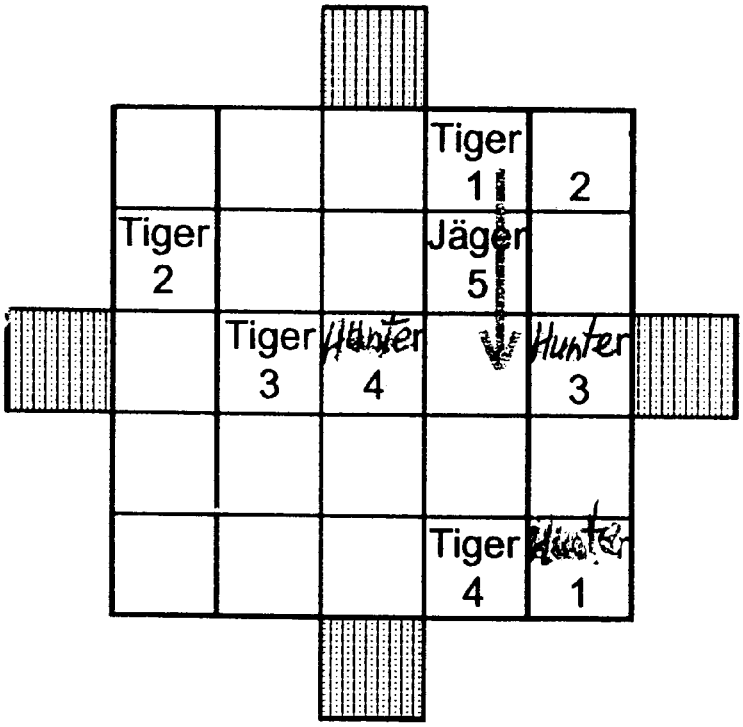
Figure 13:
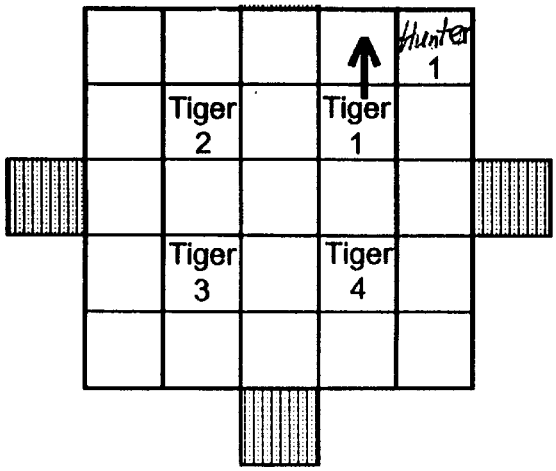
Figure 14:
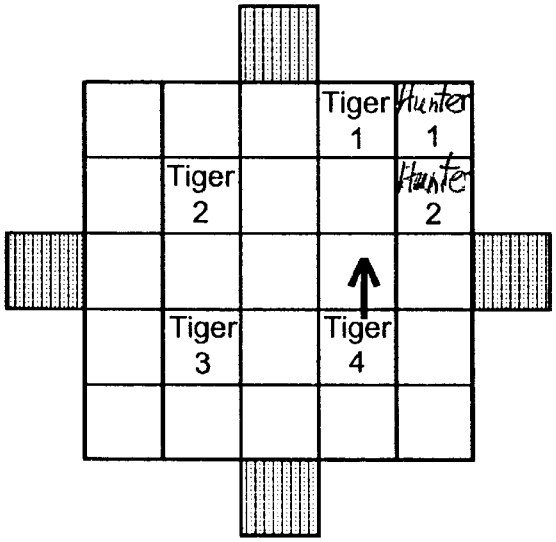
Figure 15:
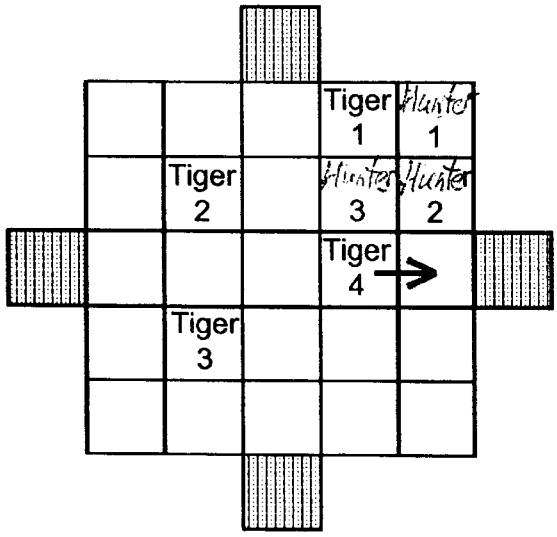
Figure 16:
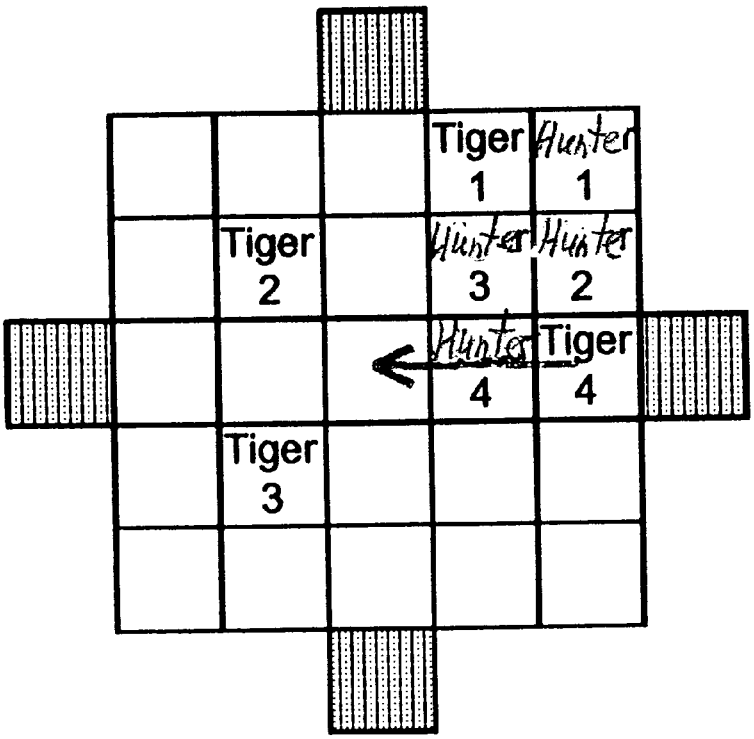
Figure 17:
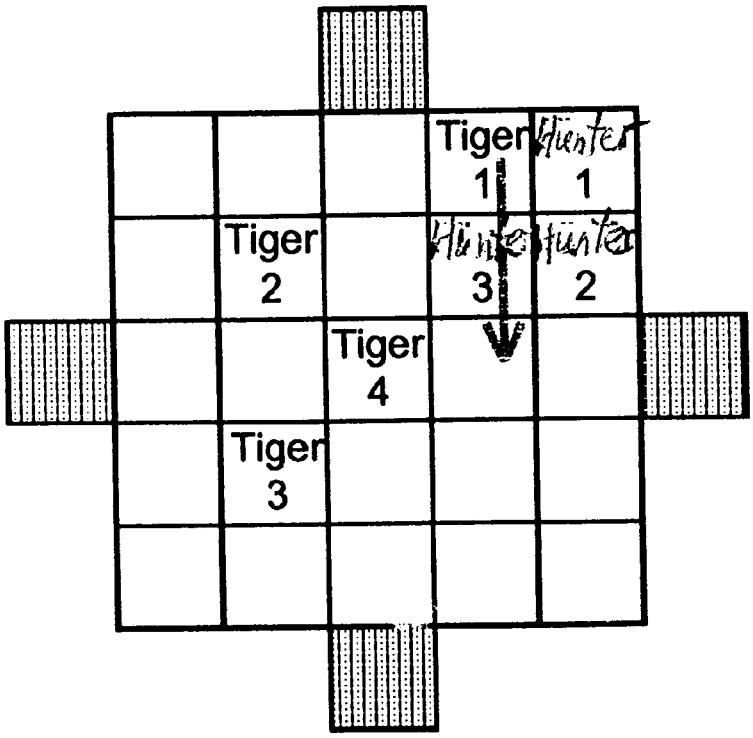

It is possible for a tiger to "eat" three hunters simultaneously. This happens when a tiger for moving between two hunters, jumps over a third hunter. This variant is shown in FIGS. 8–12. In the first movement (FIG. 8), the hunter 1 is placed on the board, and the tiger 4 moves, as indicated by arrow. In the second movement (FIG. 9), the hunter 2 is placed on the board, and the tiger 1 moves. In the third movement (FIG. 10), the hunter 3 is placed on the board, and the tiger 2 moves. In the fourth movement (FIG. 11), the hunter 4 is placed on the board, and the tiger 3 moves. Finally, in the fifth movement, the hunter 5 is placed on the board, as shown in FIG. 12. The tiger 1 jumps over the hunter 5 and into a field between the hunters 3 and four, "eating" all three hunters 5, 4, and 3. If, inadvertently, the player-tiger jumps with the tiger 3 over the hunter 4 and over the hunter 3 into the cage the tiger 3 would "eat" only two hunters (3, 4) instead of possible three hunters (3, 4, and 5). This would be an error, and the player-tiger looses the tiger 1, the one that should have "eaten " the maximum possible number of hunters.

Figure 18:
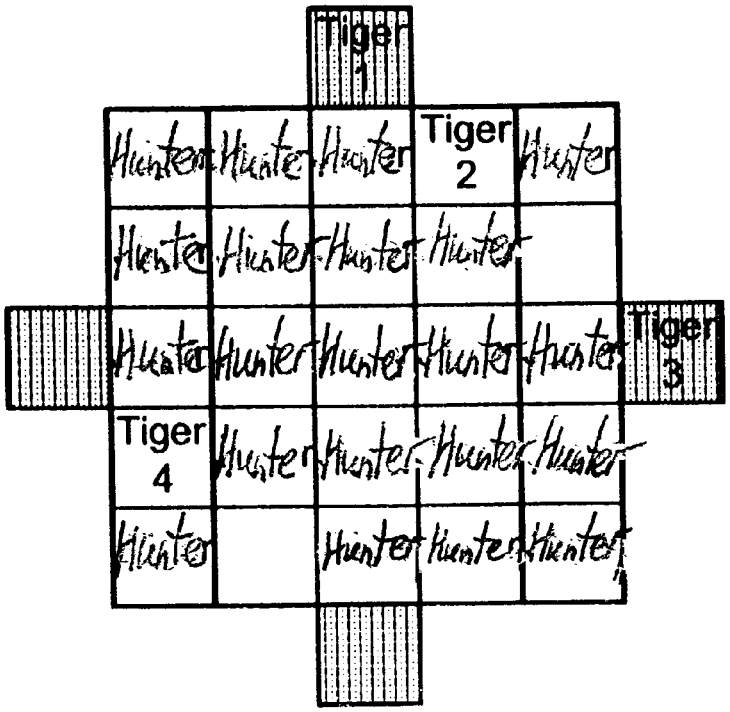
FIG. 18 shows a position in which the player-hunter wins.

As it is clear from the foregoing description, the task of the player-tiger to so move the tigers that they are able to "eat" the hunters. Possible movements as in FIGS. 13–17 which show more than one tiger "eating" hunters during one turn. The task of the player-hunter is, first, to so place the hunters that they are not "eaten" by the tigers, and are able to block any movement of the 4 tigers. A position, in which any movement of any tiger is blocked is shown in FIG. 18.

Figure 19:
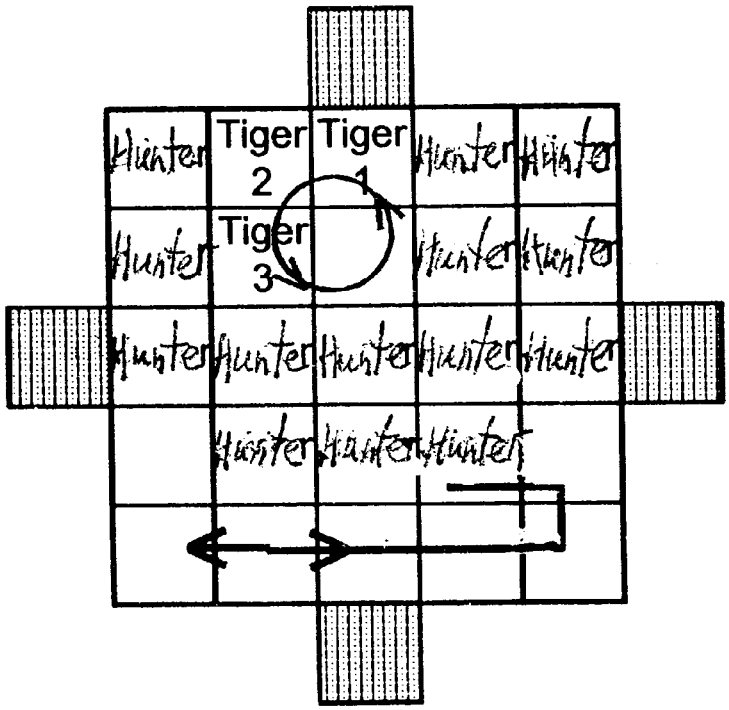
FIG. 19 shows a remis position.

A remis position is shown in FIG. 19. In this position, the three tigers (one was killed) move in a circle, one after another. The hunters have no possibility to block this movement. On the other hand, there is no possibility for any tiger to "eat" any hunter, with the hunters being able to move as shown by arrows. None of the players has any advantage. The only exception is if the player-hunter wants to continue the game. He/She can do this by luring the tigers, and sacrificing hunters regarding possible coming errors being done by the player-tiger.

Above, primarily, possible errors of the player-tiger have been discussed. The errors of the player-hunter are few. E.g., the player-hunter can move one and the same hunter more than three times in a row, which would be an error, and the player would loose the game.

Though the present invention has been shown and described with reference to a preferred embodiment, such is merely illustrative of the present invention and is not to be construed as a limitation thereof, and the present invention includes all modifications, variations and/or alternate embodiments within the spirit and scope of the present invention as defined by appended claims.

What is claimed is:

1. A set for a hunting-a-beast-of-prey game, consisting:

a square board having twenty-five playing fields and four additional playing fields provided outside of the square defining the twenty-five playing fields; and twenty-nine playing figures consisting of twenty-five figures representing hunters, and four figures representing beasts of prey, wherein each side of the square board, which includes five playing fields, has a central playing field, two opposite outer playing fields and two intermediate playing fields with each intermediate field being positioned between the central field and a respective outer field, and wherein each additional playing field is arranged against a central field of each side of the square board.

* * * * *